US010641473B2

(12) United States Patent
Roth et al.

(10) Patent No.: US 10,641,473 B2
(45) Date of Patent: May 5, 2020

(54) FOLDED HEAT SINK WITH ELECTRICAL CONNECTION PROTECTION

(71) Applicant: Valeo North America, Inc., Seymour, IN (US)

(72) Inventors: Frederick Allen Roth, Seymour, IN (US); Julien Hemon, Columbus, IN (US)

(73) Assignee: Valeo North America, Inc., Seymour, IN (US)

( * ) Notice: Subject to any disclaimer, the term of this patent is extended or adjusted under 35 U.S.C. 154(b) by 0 days.

(21) Appl. No.: 15/474,409

(22) Filed: Mar. 30, 2017

(65) Prior Publication Data

US 2018/0283665 A1 Oct. 4, 2018

(51) Int. Cl.

| | |
|---|---|
| ***F21V 1/00*** | (2006.01) |
| ***F21V 23/00*** | (2015.01) |
| ***F21V 29/74*** | (2015.01) |
| ***F21V 19/00*** | (2006.01) |
| ***F21S 45/47*** | (2018.01) |
| ***F21S 41/24*** | (2018.01) |
| ***F21S 41/29*** | (2018.01) |
| ***F21S 43/27*** | (2018.01) |
| ***F21S 43/19*** | (2018.01) |
| ***F21S 43/237*** | (2018.01) |
| ***F21S 41/19*** | (2018.01) |
| ***F21S 41/141*** | (2018.01) |
| ***F21S 43/14*** | (2018.01) |
| *F21Y 115/10* | (2016.01) |

(52) U.S. Cl.

CPC ..... *F21V 23/002* (2013.01); *F21S 41/141* (2018.01); *F21S 41/192* (2018.01); *F21S 41/24* (2018.01); *F21S 41/29* (2018.01); *F21S 43/14* (2018.01); *F21S 43/195* (2018.01); *F21S 43/237* (2018.01); *F21S 43/27* (2018.01); *F21S 45/47* (2018.01); *F21V 19/0015* (2013.01); *F21V 29/74* (2015.01); *F21Y 2115/10* (2016.08)

(58) Field of Classification Search

CPC .... F21V 23/002; F21V 19/0015; F21V 29/74; F21Y 2115/10

USPC ..... 362/235, 249.01, 294, 310, 373, 374, 362/375, 376

See application file for complete search history.

(56) References Cited

U.S. PATENT DOCUMENTS

| | | | | |
|---|---|---|---|---|
| 7,280,572 | B2 | 10/2007 | Honda | |
| 7,576,811 | B2 * | 8/2009 | Kazushige | G02B 6/0088 349/61 |
| 2005/0089070 | A1 | 4/2005 | Honda | |
| 2008/0310162 | A1 * | 12/2008 | Thomas | F21V 15/01 362/249.01 |
| 2010/0208491 | A1 * | 8/2010 | Shin | G02B 6/0091 362/606 |

(Continued)

*Primary Examiner* — William J Carter
*Assistant Examiner* — Omar Rojas Cadima
(74) *Attorney, Agent, or Firm* — Oblon, McClelland, Maier & Neustadt, L.L.P.

(57) ABSTRACT

A lighting module having a heat sink and at least one light source supported by the heat sink. A printed circuit board is also supported on the heat sink and electrically coupled to the at least one light source with at least one conductor. The heat sink is folded or formed to define a conductor protector for protecting the at least one conductor and has at least one wall that is situated in operative relationship with the at least one conductor in order to shield or protect the at least one conductor.

4 Claims, 4 Drawing Sheets

(56) References Cited

U.S. PATENT DOCUMENTS

| | | | | |
|---|---|---|---|---|
| 2011/0095690 | A1* | 4/2011 | Sagal | B29C 45/14 315/113 |
| 2015/0257250 | A1* | 9/2015 | Jeon | H05K 1/0209 361/720 |
| 2015/0362161 | A1* | 12/2015 | Gao | G02B 6/0085 362/97.1 |
| 2016/0190418 | A1* | 6/2016 | Inomata | H01L 33/507 257/98 |

* cited by examiner

FOLDED HEAT SINK WITH ELECTRICAL CONNECTION PROTECTION

BACKGROUND OF THE INVENTION

1. Field of the Invention

This invention relates to lighting modules and more particularly to a heat sink for a lighting module having electrical connector protection.

2. Description of the Related Art

Lighting modules use sub mounted electric components, such as at least one or a plurality of light sources, such as light emitting diodes (LEDs). The electrical connections, wires or ribbons tend to be fragile and can break easily, especially during manufacture or installation. If the connection between the at least one or a plurality of light sources and the printed circuit board is broken, then the at least one or a plurality of light sources may fail which can make the entire lighting module fail.

What is needed, therefore, is a system and method for protecting the fragile connections, wires or ribbons and to protect them during all manufacturing processes, especially handling and installation.

SUMMARY OF THE INVENTION

It is, therefore, a primary object of the invention to provide a system, means and method for protecting electrical connections, wires or ribbons between a printed circuit board and at least one or a plurality of light sources.

Another object of the invention is to provide a heat sink that can support the at least one or a plurality of light sources, while simultaneously protecting the electrical connections, wires or ribbons used to couple the at least one or a plurality of light sources to the printed circuit board.

Another object of the invention is to provide a system, method and means for protecting the electrical connections, wires or ribbons from contact.

In one aspect, one embodiment of the invention comprises a lighting module comprising a heat sink, at least one light source supported by the heat sink, a printed circuit board also supported on the heat sink and electrically coupled to the at least one light source with at least one conductor, the heat sink comprising a conductor protector for protecting the at least one conductor.

This invention, including all embodiments shown and described herein, could be used alone or together and/or in combination with one or more of the features covered by one or more of the following list of features:

The lighting module wherein the heat sink is folded or formed to define the conductor protector.

The lighting module wherein the heat sink comprises at least one wall situated in operative relationship with the at least one conductor in order to shield or protect the at least one conductor.

The lighting module wherein the heat sink comprises a plurality of walls situated in operative relationship with the at least one conductor in order to shield or protect the at least one conductor.

The lighting module wherein the plurality of walls comprises a first wall portion and a generally opposing second wall portion, the at least one conductor being located between the first and second wall portions.

The lighting module wherein the at least one light source and the printed circuit board are also located between the first and second wall portions.

The lighting module wherein the first wall portion is situated on a first side of the heat sink and the second wall portion is situated on a second side of the heat sink.

The lighting module wherein the heat sink comprises a body that is folded in a plurality of areas to define the plurality of walls, respectively.

The lighting module wherein the plurality of walls comprise a height that is greater than either a height of either the printed circuit board after it is mounted on the heat sink or a height of the at least one light source after it is mounted on the heat sink.

The lighting module wherein the plurality of walls are not angled with respect to a support area of the heat sink where the printed circuit board is mounted.

The lighting module wherein the lighting module comprises a light guide for mounting on the heat sink in operative relationship with the at least one light source.

The lighting module wherein the heat sink and the light guide comprises a mount that causes an input surface of the light guide to become registered with respect to the at least one light source.

The lighting module wherein the plurality of walls each comprise at least one aperture adapted to receive at least a portion of a flexible arm of a cover when the cover is mounted on the heat sink.

These and other objects and advantages of the invention will be apparent from the following description, the accompanying drawings and the appended claims.

BRIEF DESCRIPTION OF THE ACCOMPANYING DRAWINGS

DETAILED DESCRIPTION OF THE PREFERRED EMBODIMENTS

Figure 5A:
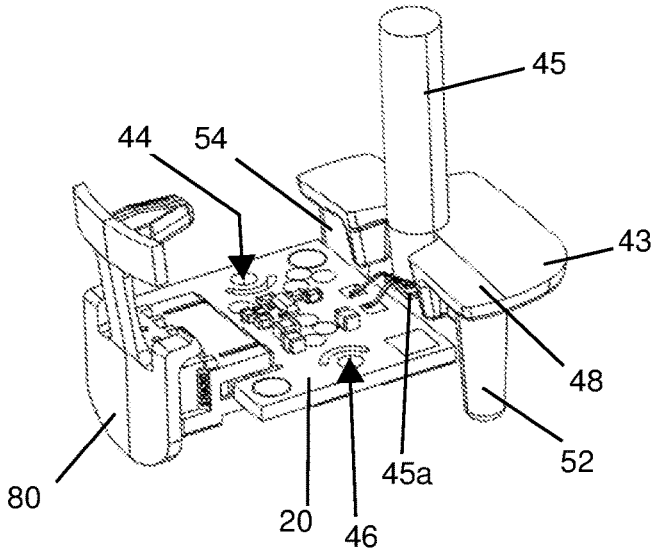
FIG. 5A is a view of the various components, but without the heat sink.
Figure 5B:
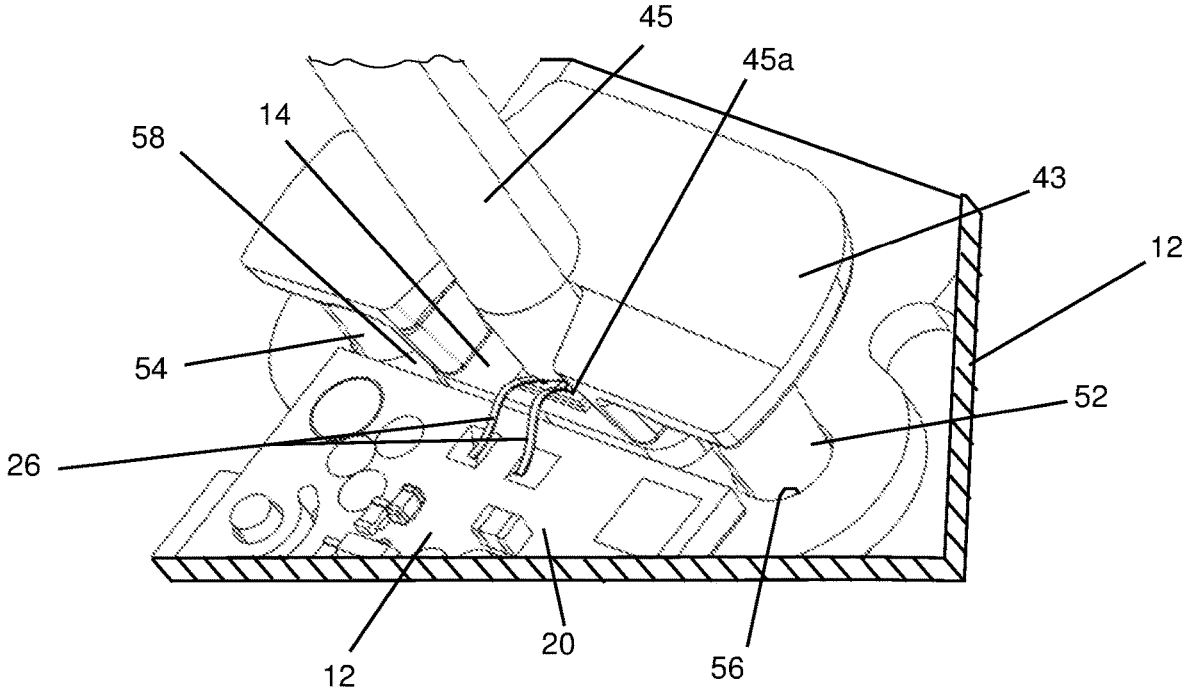
FIG. 5B is another fragmented view enlarged to show various features of the embodiment.
Figure 6:
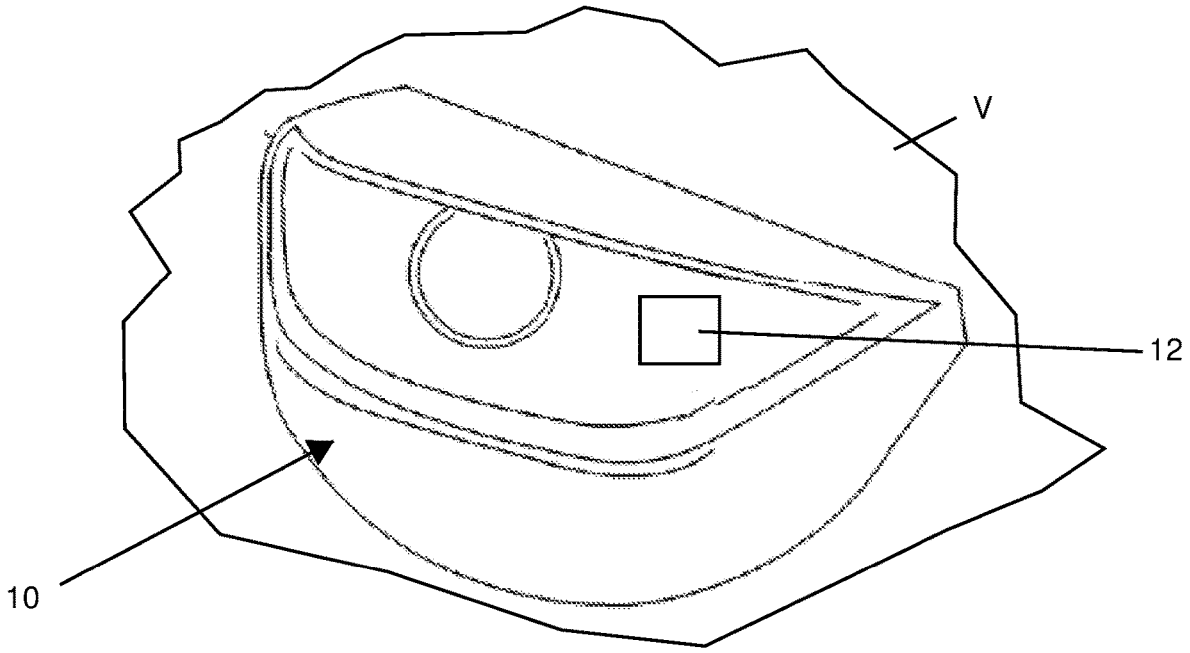
FIG. 6 is a vehicle headlamp assembly having the lighting module assembly in accordance with one embodiment of the invention.
Figure 7:
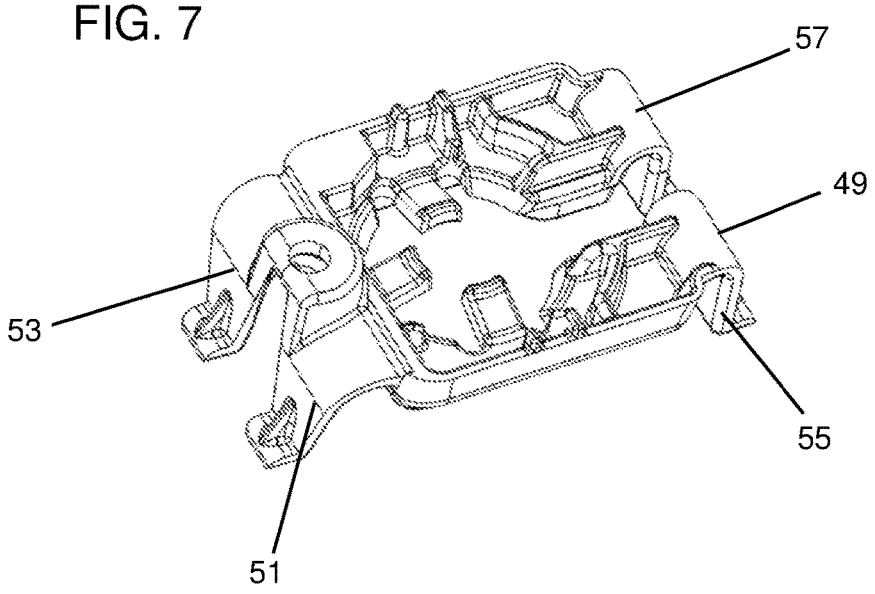
FIG. 7 is a view of a cover for mounting on the heat sink.

Referring now to FIGS. 1-7, a lighting module assembly 10 is shown for use on a vehicle V (FIG. 6). The lighting module assembly 10 comprises a heat sink 12 having a landing 14 onto which at least one or a plurality of light sources 16 is mounted. In the illustration being described, the at least one or plurality of light sources 16 are mounted directly to a surface 14*a* (FIGS. 3-4B) of the landing 14. In the illustration being described, the at least one or plurality of light sources 16 may be a solid state light source, a light emitting diode or LED (e.g., one chip or multichip, highly pixellized LED, organic LED, or a laser diode). In the illustration, the lighting module assembly 10 comprising the heat sink 12 is mounted on the vehicle V shown in fragmentary view in FIG. 6.

Figure 3:
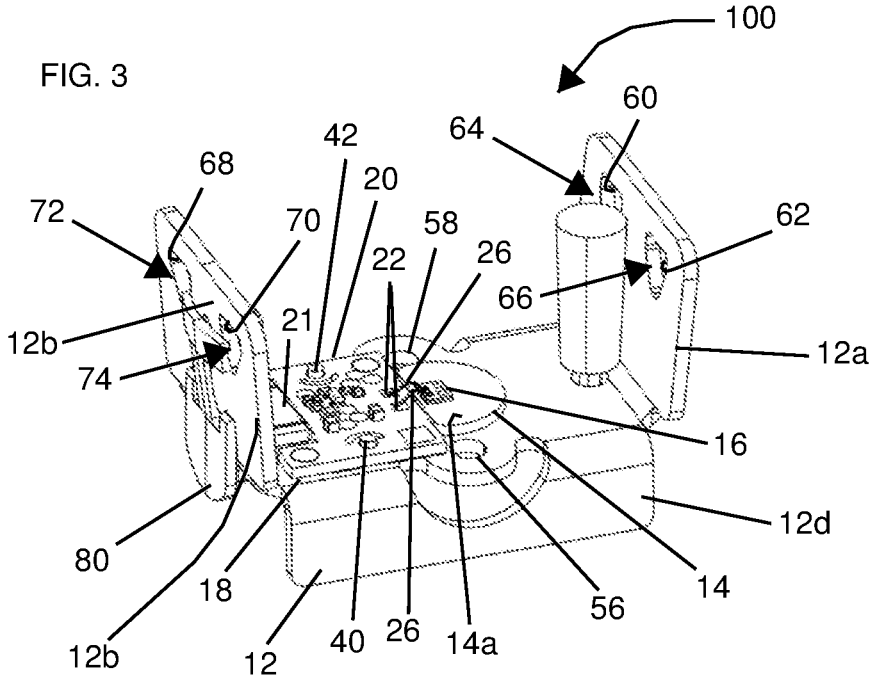
FIG. 3 is a front view of the lighting module assembly showing various features of the embodiment.

The heat sink 12 also comprises a circuit board support surface 18 for supporting a printed circuit board 20 as best illustrated in FIG. 3. Note that the circuit board 20 is conventionally mounted to the circuit board support surface 18 in operative relationship with the at least one or plurality of light sources 16.

Figure 4A:
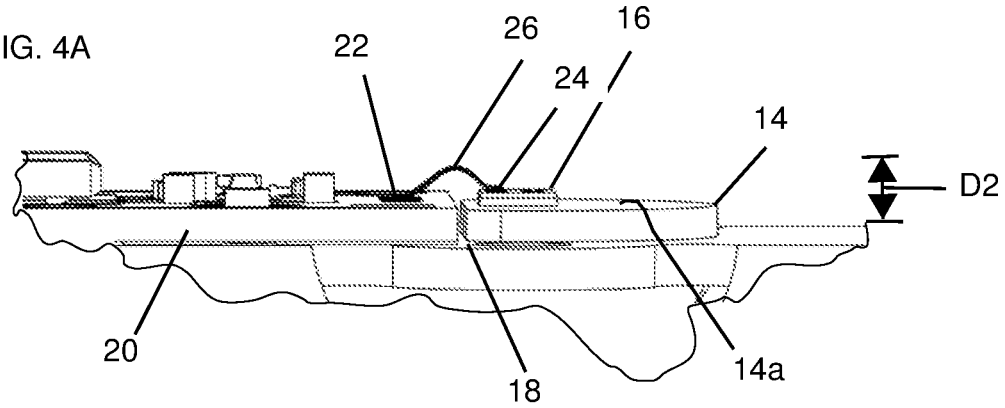
FIGS. 4A and 4B are fragmentary views showing a printed circuit board and at least one light source mounted on the heat sink having electrical connections therebetween.
Figure 4B:
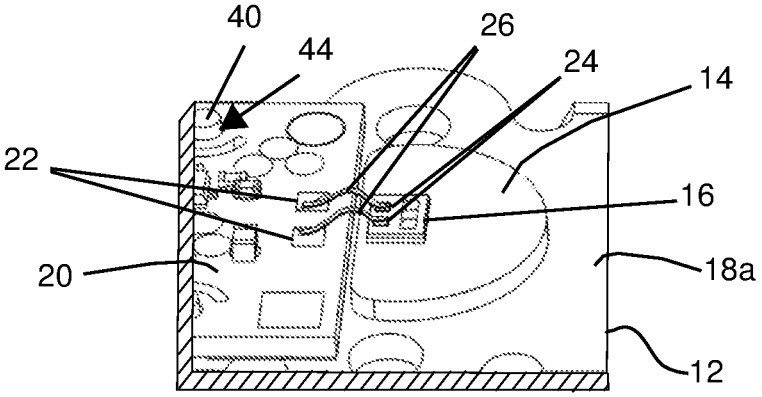

As best illustrated in FIG. 4B, the printed circuit board 20 comprises a plurality of vias or conductors 22 and the at least one or plurality of light sources 16 comprises a plurality of vias or conductors 24. A plurality of wires, jumpers or ribbons 26 couple the conductors 22 to conductors 24 associated with the at least one or plurality of light sources 16 as best illustrated in FIG. 4B. It should be understood that it is not uncommon that the wires, jumpers or ribbons 26 are formed or provided in a ribbon (not shown). In the prior art, this connection between the printed circuit board 20 and the at least one or plurality of light sources 16 could become damaged or broken, for example, during assembly or installation.

After the printed circuit board 20 is conventionally mounted on the surface 18*a* (FIG. 4B) and the at least one or plurality of light sources 16 are mounted on the surface 14*a* of the landing 14, the wires, jumpers or ribbons 26 electrically couple the printed circuit board 20 to the at least one or plurality of light sources 16. Thereafter, the other portions of the lighting module assembly 10 may be assembled. In the illustration being described, the wires, jumpers or ribbons 26 electrically couple the printed circuit board 20 to the at least one or plurality of light sources 16 after the printed circuit board 20 is received on the heat sink 12. In this regard, note that the heat sink 12 may comprise at least one or a plurality of registration or guide posts 40, 42 (FIG. 3) that are received in apertures 44, 46 (FIG. 5A), respectively, in the printed circuit board 20. The frustoconically-shaped guide posts 40 facilitate positioning or registering the conductors 22 in operative relationship with the conductors 24 so that the wires, jumpers or ribbons 26 may be soldered into position to electrically couple the printed circuit board 20 to the at least one or plurality of light sources 16. Alternatively, the printed circuit board 20 and the at least one or plurality of light sources 16 may be provided with the wires, jumpers or ribbons 26 already connecting these components so that when the printed circuit board 20 is mounted on the surface 18*a*, the at least one or plurality of light sources 16 can be mounted on the landing 14.

Note that the lighting module assembly 10 includes a light guide or light pipe 43 having a generally cylindrical light guide body 45 coupled to a mounting body 48. The mounting body 48 comprises a pair of frustoconically-shaped locaters or posts 52 and 54 that are received in a pair of apertures 56 and 58 to properly locate and register an input surface or end 45*a* of the generally cylindrical light guide body 45 relative to the at least one or plurality of light sources 16 as best illustrated in FIGS. 5A and 5B.

In the illustration being described, the heat sink 12 is processed, folded or bent to the configuration illustrated in FIG. 3. In the illustration being described, the heat sink 12 comprises a conductor protector comprising a first wall portion 12*a* and a generally opposing and generally parallel second wall portion 12*b*, as best illustrated in FIG. 3. The first and second wall portions 12*a* and 12*b* are angled relative to the circuit board mounting surface. During formation, the heat sink 12 is provided in a generally planar sheet and is bended or folded as illustrated in FIG. 3 to provide the first and second wall portions 12*a* and 12*b*. It is important to note that the first and second wall portions 12*a* and 12*b* provide protection for the printed circuit board 20, the at least one or plurality of light sources 16 and the wires, jumpers or ribbons 26 as illustrated. The first and second wall portions 12*a* and 12*b* also provide means for handling the lighting module assembly 10, for example, while the light guide or light pipe 43 is mounted on the heat sink 12 as illustrated in FIGS. 3 and 5B.

Note that once the printed circuit board 20 is mounted on the circuit board support surface 18 and the at least one or plurality of light sources 16 are mounted on the landing 14 and the wires, jumpers or ribbons 26 electrically couple the printed circuit board 20 to at least one or plurality of light sources 16, the light guide or light pipe 43 can be mounted onto the heat sink 12 by guiding the posts 52 and 54 into the respective apertures 56 and 58. Note that when this is done, the end 45*a* of the generally cylindrical light guide body 45 becomes operatively associated and registered relative to the at least one or plurality of light sources 16.

Figure 1:
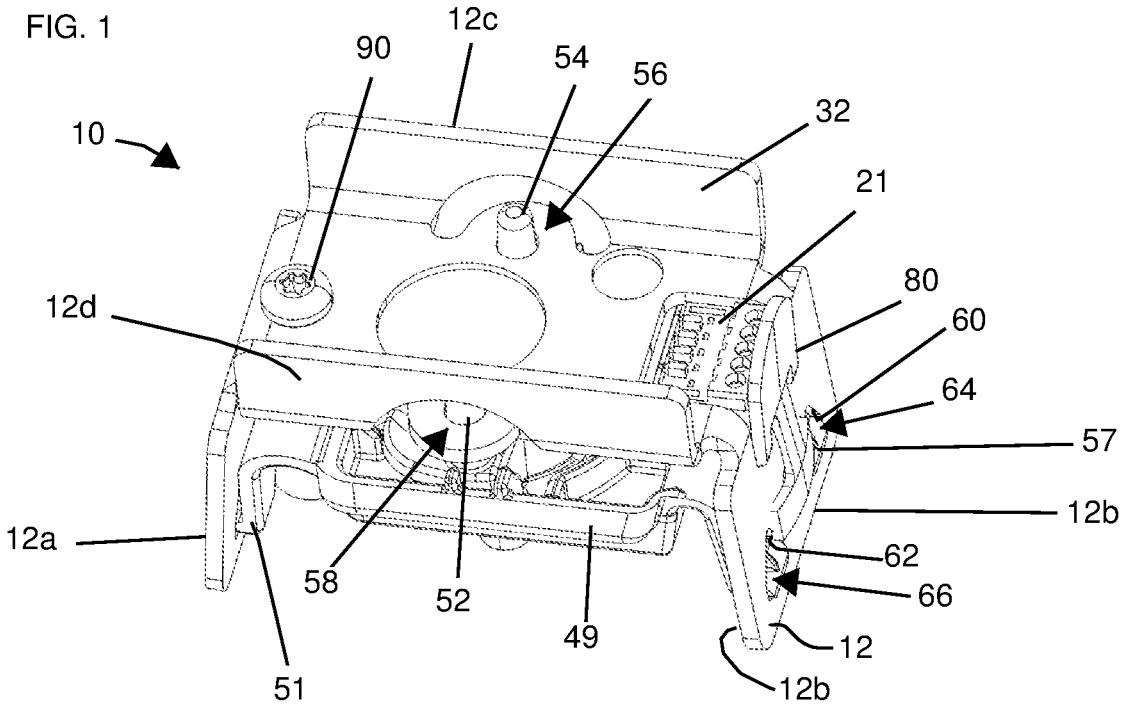
FIG. 1 is a view of a lighting module assembly in accordance with one embodiment of the invention.

After the light guide or light pipe 43 is mounted on the heat sink 12, a retaining cover 49 (FIGS. 2 and 7) can be secured to the heat sink 12. In the illustration being described, the first wall portion 12*a* comprises a plurality of interior walls 60 and 62 that define apertures 64 and 66, respectively. Likewise, the generally opposing second wall portion 12*b* comprises interior walls 68 and 70 that define apertures 72 and 74, respectively. As best illustrated in FIGS. 1 and 3, note that the printed circuit board 20 comprises a female connector 21 that mates with a mating male connector (not shown) in a manner conventionally known. During transport and assembly of the lighting module assembly 10, a connector protector 80 (FIG. 2) may be mounted on the female connector 21. The connector protector 80 having a tongue (not shown) that is inserted into a female aperture (not shown) of the female connector 21. The connector protector 80 comprises a base 82 that is mounted onto the heat sink 12 using a weld, adhesive or other type of fastener. The arm 84 of the connector protector 80 is resilient and permits the head 86 of the connector protector 80 to be moved and dismounted from the heat sink 12 and the female connector 21.

Figure 2:
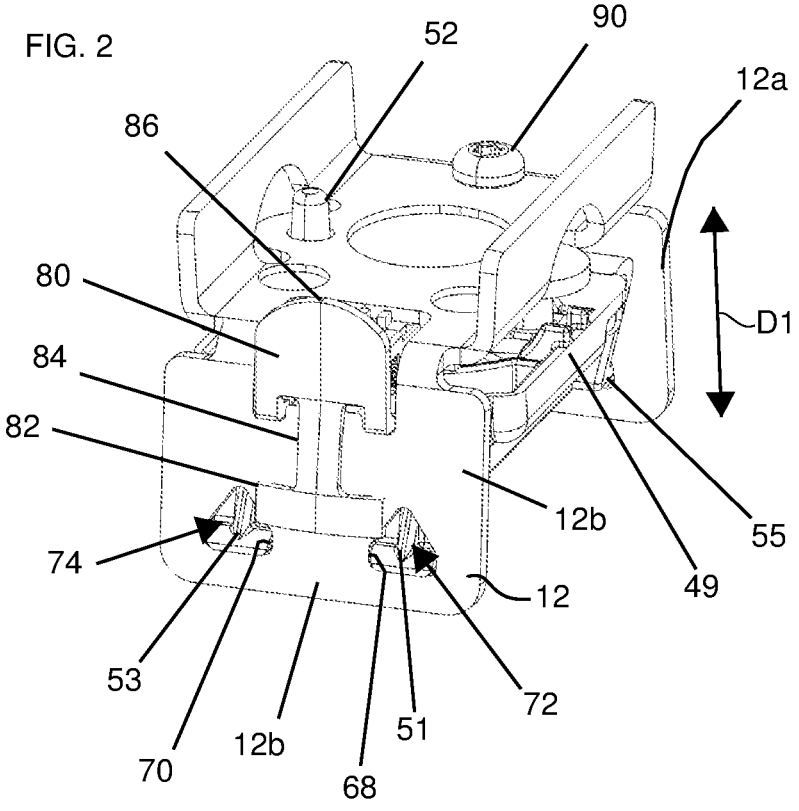
FIG. 2 is a view of a heat sink utilized in the lighting module assembly shown in FIG. 1.

As best illustrated in FIGS. 1 and 2, the cover 49 comprises at least one or a plurality of resilient arms or detents 51, 53, 55 and 57 (FIGS. 2 and 7) that are received in the apertures 72, 74, 66 and 64, respectively, and cooperate with the walls 68, 70, 62 and 60 thereof to lock and hold the components, such as the cylindrical light guide body 45, in place. A screw 90 may also be used to secure the cover 49 to the heat sink 12 as illustrated in FIG. 1.

Advantageously, the folded first and second wall portions 12*a* and 12*b* provide flexibility in design and processing and are generated at lower cost than the heat sinks of the past. The folded first and second wall portions 12*a* and 12*b* protect the at least one or plurality of light sources 16 and the wires, jumpers or ribbons 26 without the need for additional parts or assembly steps.

It should be understood that while the heat sink 12 has been shown with the folded first and second wall portions 12*a* and 12*b*, more or fewer walls may be used. For example, a single wall could be used or a plurality of walls, such as three or four walls, could be integrally or monolithically formed on the heat sink 12 and surround the various components mounted on the heat sink 12. It is important to note that the folded first and second wall portions 12*a* and 12*b* are a predetermined height or dimension D1 (FIG. 2) which in the embodiment being described is higher than the dimension D2 (FIG. 4A), namely, higher than the dimension of the at least one or plurality of light sources 16 or wires, jumpers or ribbons 26 so that they shield the various components mounted to the heat sink 12 and block any entrance into the area 100 (FIG. 3) by any unwanted object or even during handling during assembly.

The heat sink 12 may have other folded walls, such as walls 12*c* and 12*d*.

This invention, including all embodiments shown and described herein, could be used alone or together and/or in combination with one or more of the features covered by one or more of the claims set forth herein, including but not limited to one or more of the features or steps mentioned in the Summary of the Invention and the claims.

While the system, apparatus and method herein described constitute preferred embodiments of this invention, it is to be understood that the invention is not limited to this precise system, apparatus and method, and that changes may be made therein without departing from the scope of the invention which is defined in the appended claims.

What is claimed is:

1. A lighting module of a vehicle comprising:

a heat sink;

at least one light source mounted on a landing supported by said heat sink; and a printed circuit board mounted on a circuit board support surface supported on said heat sink and electrically coupled to said at least one light source with at least one conductor, wherein said heat sink includes a conductor protector for protecting said at least one conductor, wherein said heat sink is monolithic and includes a planar portion, a top surface of the planar portion supporting said landing and said circuit board support surface, first and second walls respectively provided on first and second sides of said planar portion, said first and second walls defining said conductor protector, free ends of said first and second walls being higher than said top surface of said planar portion, and third and fourth walls respectively provided on third and fourth sides of said planar portion, said third and fourth sides connecting the first and second sides of said planar portion, wherein said at least one light source, said printed circuit board, and said at least one conductor are disposed on the top surface of the planar portion adjacent each other in a lengthwise direction between said first and second walls, and the at least one light source, said printed circuit board, and said at least one conductor are entirely disposed between said first and second walls in the lengthwise direction, wherein free ends of said third and fourth walls are lower than said top surface of said planar portion, wherein the free ends of the third and fourth walls are continuous in the lengthwise direction opposite the at least one light source, said printed circuit board, and said at least one conductor, and wherein the lighting module further comprises a light guide for mounting on said heat sink in operative relationship with said at least one light source, the light guide including a generally cylindrical light guide body coupled to a mounting body which mounts the light guide onto the heat sink such that an input surface of said light guide is registered with respect to said at least one light source.

2. The lighting module as recited in claim 1, wherein each of said first and second walls includes an aperture adapted to receive at least a portion of a flexible arm of a cover when the cover is mounted on the heat sink.

3. The lighting module as recited in claim 1, wherein the planar portion includes two apertures which receive two posts of the mounting body coupled to the light body, the two apertures being disposed on either side of the landing, and wherein the third and fourth walls each includes a cut out at a location of the two apertures in the lengthwise direction between the first and second walls.

4. A method of manufacturing a lighting module of a vehicle comprising:

providing a heat sink, the heat sink being a monolithic planar sheet;

folding the heat sink such that the heat sink presents a planar portion and first and second walls respectively provided on first and second sides of said planar portion, free ends of said first and second walls being higher than a top surface of said planar portion;

folding the heat sink such that the heat sink presents third and fourth walls respectively provided on third and fourth sides of said planar portion, said third and fourth sides connecting the first and second sides of said planar portion, free ends of said third and fourth walls being lower than said top surface of said planar portion;

providing a landing on said top surface of said planar portion; said landing is being supported by said heat-sink;

mounting at least one light source on said mounting;

providing a circuit board support surface on said top surface of said planar portion;

mounting a printed circuit board on said circuit board support surface;

electrically coupling said printed circuit board to said at least one light source with at least one conductor; and mounting a light guide on said heat sink in operative relationship with said at least one light source, the light guide including a generally cylindrical light guide body coupled to a mounting body which mounts the light guide onto the heat sink such that an input surface of said light guide is registered with respect to said at least one light source, wherein said at least one light source, said printed circuit board, and said at least one conductor are disposed on the top surface of the planar portion adjacent each other in a lengthwise direction between said first and second walls, and the at least one light source, said printed circuit board, and said at least one conductor are entirely disposed between said first and second walls in the lengthwise direction, and wherein the free ends of the third and fourth walls are continuous in the lengthwise direction opposite the at least one light source, said printed circuit board, and said at least one conductor.

* * * * *